US005651294A

United States Patent [19]

Shiao

[11] Patent Number: 5,651,294

[45] Date of Patent: Jul. 29, 1997

[54] HIGH TORSION SCREWDRIVER

[76] Inventor: Hsuan-Sen Shiao, No. 15-1, Lane 369, Min-Chuan Rd., Pei-Dist., Taichung City, Taiwan

[21] Appl. No.: 597,911

[22] Filed: Feb. 7, 1996

[51] Int. Cl.[6] ..... B25B 13/46

[52] U.S. Cl. ..... 81/59.1; 81/63.1

[58] Field of Search ..... 81/59.1, 63.1

[56] References Cited

U.S. PATENT DOCUMENTS 5,406,866 4/1995 Badiali ..... 81/59.1 X 5,499,559 3/1996 Lin ..... 81/59.1

*Primary Examiner*—D. S. Meislin

*Attorney, Agent, or Firm*—Ladas & Parry

[57] ABSTRACT

A screwdriver includes a seater which is formed with an axially extending polygonal hole that is defined by a plurality of curved locking sides, and a positioning member which has an annular rotary plate and a tubular portion that extends from the rotary plate and that is disposed in the polygonal hole. Each of the locking sides forms a curved clearance with the tubular portion. The clearance has two tapering end sections and a wide intermediate section. The tubular portion is formed with a plurality of axially extending positioning slits adjacent to the locking sides, respectively. A plurality of cylindrical locking rods are disposed respectively in the positioning slits. A drive shaft extends through the positioning member and the seater and contacts the locking rods.

5 Claims, 3 Drawing Sheets

HIGH TORSION SCREWDRIVER

BACKGROUND OF THE INVENTION

1. Field of the Invention

The invention relates to a screwdriver, more particularly to a high torsion screwdriver which is simple in construction and which is easy to assemble.

2. Description of the Related Art

High torsion screwdrivers, such as ratchet screwdrivers, are known in the art. However, conventional ratchet screwdrivers are relatively complicated in construction and are inconvenient to assemble.

SUMMARY OF THE INVENTION

Therefore, the object of the present invention is to provide a high torsion screwdriver which is simple in construction and which is easy to assemble.

Accordingly, the high torsion screwdriver of the present invention comprises:

- a seater formed with an axially extending polygonal hole that is defined by a plurality of curved locking sides;
- a positioning member having an annular rotary plate and a tubular portion which extends from the rotary plate and which is disposed in the polygonal hole, each of the locking sides forming a curved clearance with the tubular portion, the clearance having two tapering end sections and a wide intermediate section, the tubular portion being formed with a plurality of axially extending positioning slits adjacent to the locking sides respectively;
- a plurality of cylindrical locking rods disposed respectively in the positioning slits; and
- a drive shaft extending through the positioning member and the seater and contacting the locking rods.

The positioning member is rotatable so as to dispose the locking rods in a selected one of the tapering end sections of the clearance that is formed between the tubular portion and the respective one of the locking sides in order to enable the locking rods to lock the drive shaft to the seater when the seater is driven to rotate in one direction and in order to enable the locking rods to permit idle rotation of the seater with respect to the drive shaft when the seater is driven to rotate in an opposite direction.

Preferably, a rotary knob is sleeved rotatably on the drive shaft for covering the rotary plate of the positioning member. The rotary knob is connected operably to the rotary plate to permit rotation of the positioning member therewith.

The seater has one end formed with a central depression that is covered by the rotary plate of the positioning member. The central depression is defined by a surrounding wall which has a radial inward retaining projection. The rotary plate is formed with a radial outward guide notch which extends from one of the positioning slits. The screwdriver further comprises a spring disposed between the rotary knob and the rotary plate of the positioning member. The spring is formed as a thin curved strip with a first insert leg connected to the rotary plate and a second insert leg which extends into the guide notch and which is disposed in the central depression so as to abut against the retaining projection.

Preferably, the retaining projection is generally triangular in shape and has a tip portion aligned with one corner of the polygonal hole and a pair of inclined side portions.

A handle body is formed with an axial insert hole for receiving the seater therein.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
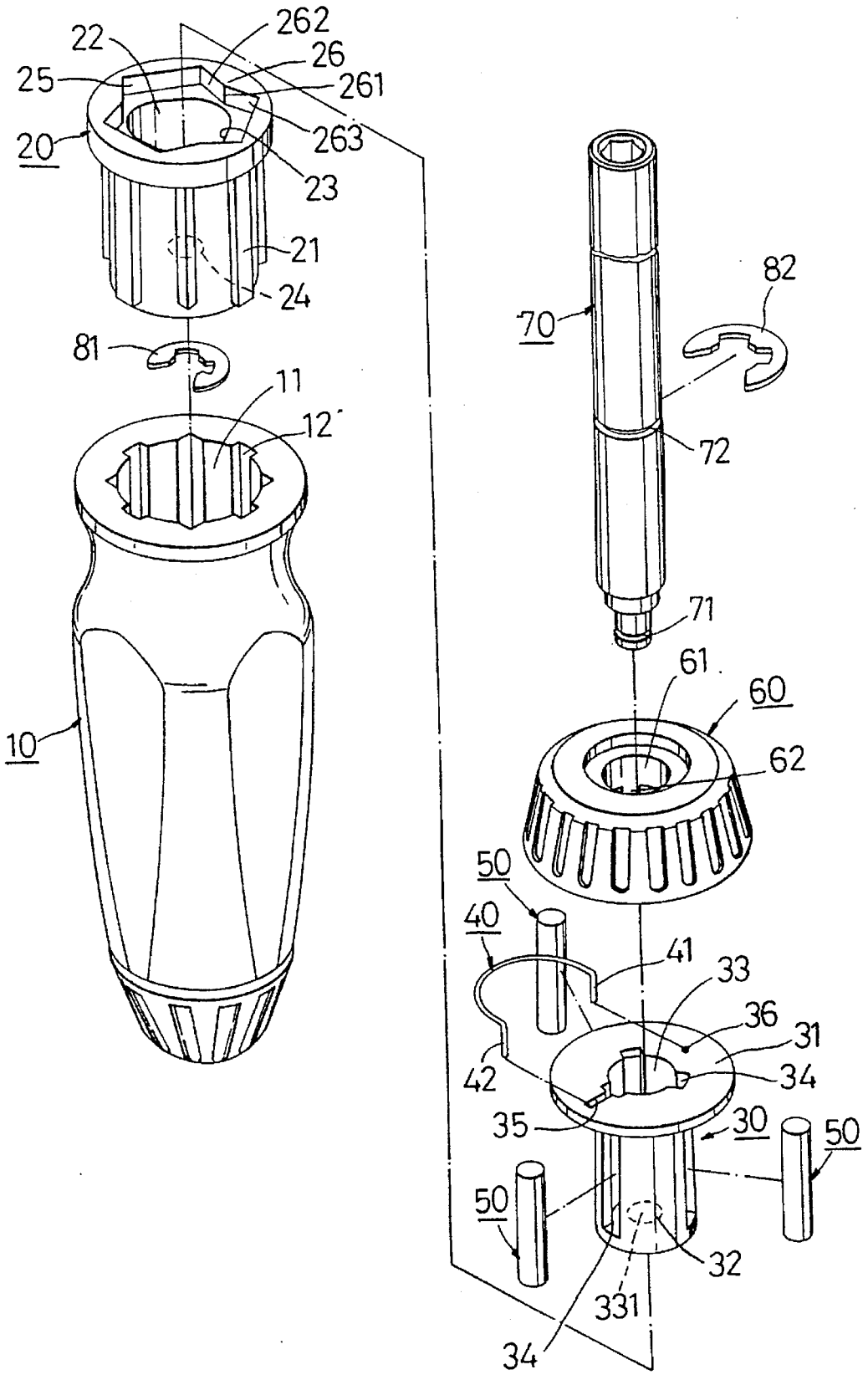
FIG. 1 an exploded view of the preferred embodiment of a high torsion screwdriver according to the present invention.

Referring to FIG. 1, the preferred embodiment of a high torsion screwdriver according to the present invention is shown to comprise a handle body 10, a seater 20, a positioning member 30, a spring 40, three cylindrical locking rods 150, a rotary knob 60 and a drive shaft 70.

The handle body 10 is a hollow member which is formed with an axial insert hole 11 in one end. The handle body 10 has an inner wall surface formed with a plurality of axially extending grooves 12.

The seater 20 is a hollow member which has an outer wall surface formed with a plurality of axially extending projections 21. The seater 20 is to be received in the insert hole 11 such that the projections 21 extend into the grooves 12. The seater 20 is formed with an axially extending polygonal hole 22. In this embodiment, the polygonal hole 22 is a triangular hole defined by three curved locking sides 23. The seater 20 has a first end formed with a small through-hole 24, and an opposite second end formed with a central depression 25. In this embodiment, the central depression 25 is defined by a surrounding wall having three radial inward retaining projections 26 albeit only one retaining projection 26 is sufficient, as will be noted in the succeeding paragraphs. Each of the retaining projections 26 is generally triangular in shape and has a tip portion 261 aligned with one of the corners of the polygonal hole 22 and a pair of inclined side portions 262, 263.

Figure 3:
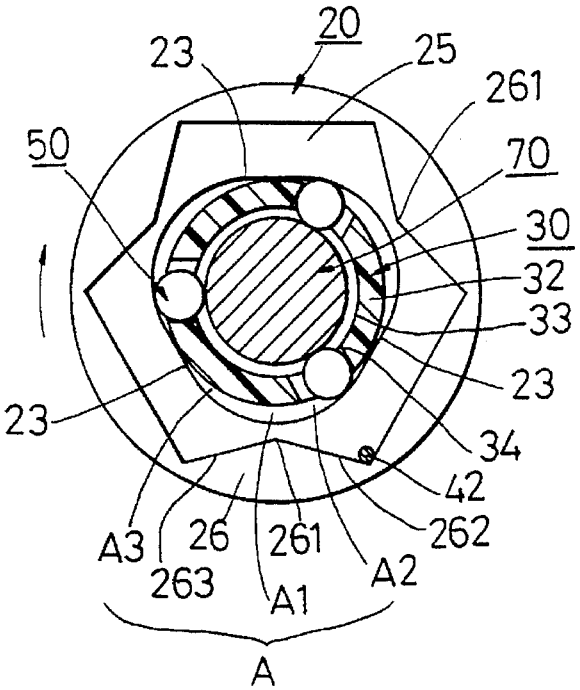
FIG. 3 is a sectional view illustrating the preferred embodiment when in a first operating mode.

The positioning member 30 includes an annular rotary plate 31 and a tubular portion 32 extending from the rotary plate 31. The rotary plate 31 is formed with an opening 33 which is coaxial with the tubular portion 32. The tubular portion 32 has one end which is opposite to the rotary plate 31 and which is formed with a smaller opening 331. The tubular portion 32 is formed with three axially extending positioning slits 34 which extend to the rotary plate 31. The rotary plate 31 is further formed with a radial outward guide notch 35 which extends from one of the positioning slits 34, and a retaining hole 36 which is spaced by a 120° angle from the guide notch 35. The tubular portion 32 is to be disposed in the polygonal hole 22 in such a manner that the rotary plate 31 covers the central depression 25 and that the positioning slits 34 are adjacent to the locking sides 23, respectively. As shown in FIG. 3, each of the curved locking sides 23 forms a curved clearance (A) with the tubular portion 32. Each clearance (A) has two tapering end sections (A2), (A3) and a wide intermediate section (A1).

The spring 40 is formed as a thin curved strip having two transversely extending insert legs 41, 42. The insert leg 41 is inserted through the retaining hole 36 to connect the spring 40 with the positioning member 30. The insert leg 42 extends into the guide notch 35 and is disposed in the central depression 25 so as to abut against one of the side portions 262, 263 of one of the retaining projections 26.

Each of the locking rods 50 is to be disposed in one of the positioning slits 34 and contacts a corresponding one of the locking sides 23.

The rotary knob 60 encloses the rotary plate 31 of the positioning member 30 therein, thereby retaining the spring 40 between the rotary knob 60 and the positioning member 30. The rotary knob 60 has a through-hole 61 formed therethrough and an inner wall surface formed with three locking projections 62 which extend into the positioning slits 34 in the rotary plate 31 to connect operably the rotary knob 60 to the positioning member 30 in order to permit rotation of the positioning member 30 with the rotary knob 60.

The drive shaft 70 is formed with a spaced pair of annular retaining grooves 71, 72 and extends through the through-hole 61 in the rotary knob 60, the openings 33, 331 in the positioning member 30 and the holes 22, 24 in the seater 20. The assembly of the rotary knob 60, the positioning member 30 and the seater 20 are disposed between the retaining grooves 71, 72 when installed on the drive shaft 70. A pair of retaining rings 81, 82 engage the retaining grooves 71, 72 respectively to secure the assembly of the rotary knob 60, the positioning member 30 and the seater 20 on the drive shaft 70.

Figure 2:
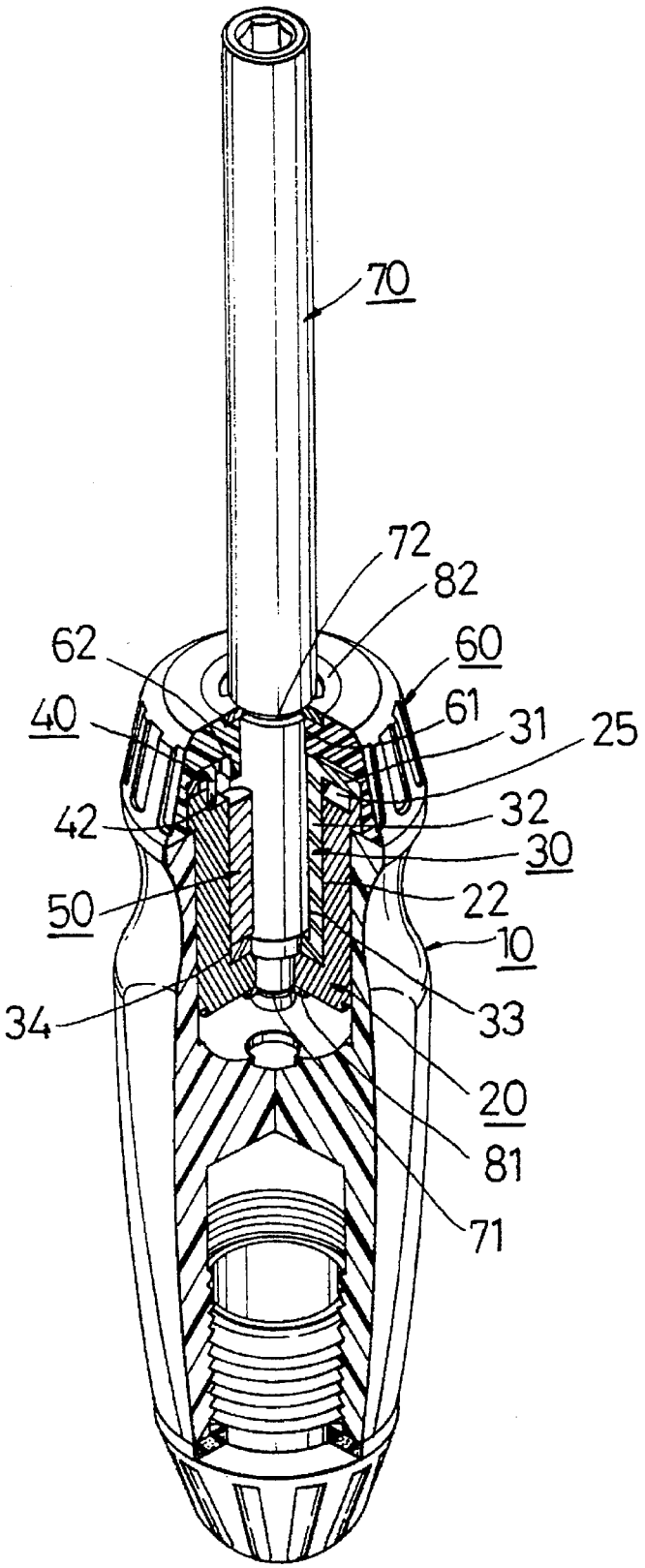
FIG. 2 is a perspective, partly sectional view of the preferred embodiment.

Referring to FIG. 2, during assembly, the tubular portion 32 of the positioning member 30 is inserted into the polygonal hole 22 in the seater 20 whilst the locking rods 50 are disposed respectively in the positioning slits 34. The insert legs 41, 42 of the spring 40 are inserted through the guide notch 35 and the retaining hole 36 in the rotary plate 31, respectively. The insert leg 42 extends into the central depression 25 in the seater 20 at this time. The locking projections 62 on the rotary knob 60 are extended into the positioning slits 34 in the rotary plate 31 to secure the positioning member 30 onto the rotary knob 60. Then, the drive shaft 70 is extended through the through-hole 61 in the rotary knob 60, the openings 33, 331 in the positioning member 30 and the holes 22, 24 in the seater 20, and the retaining rings 81, 82 engage the retaining grooves 71, 72 to secure the assembly of the rotary knob 60, the positioning member 30 and the seater 20 on the drive shaft 70. Finally, the seater 20 is received in the insert hole 11 of the handle body 10. Assembly of the preferred embodiment is completed at this time.

FIG. 3 illustrates the preferred embodiment when in a first operating mode. As shown, the insert leg 42 of the spring 40 abuts against the side portion 262 and prevents undesired rotation of the rotary knob 60 and the positioning member 30 in the polygonal hole 22. Under this condition, the locking rods 50 are disposed in the tapering end section (A2) of the respective clearance (A) and are in contact with the drive shaft 70 and the respective curved locking side 23. When the handle body 10 is rotated in a clockwise direction, the curved locking sides 23 force the locking rods 50 to contact tightly the drive shaft 70, thereby locking the drive shaft 70 to the handle body 10. When the handle body 10 is rotated in a counterclockwise direction, the locking rods 50 are disposed in the intermediate section (A1) of the respective clearance (A) and rotate freely to result in idle rotation of the handle body 10 and the seater 20 with respect to the drive shaft 70.

Figure 4:
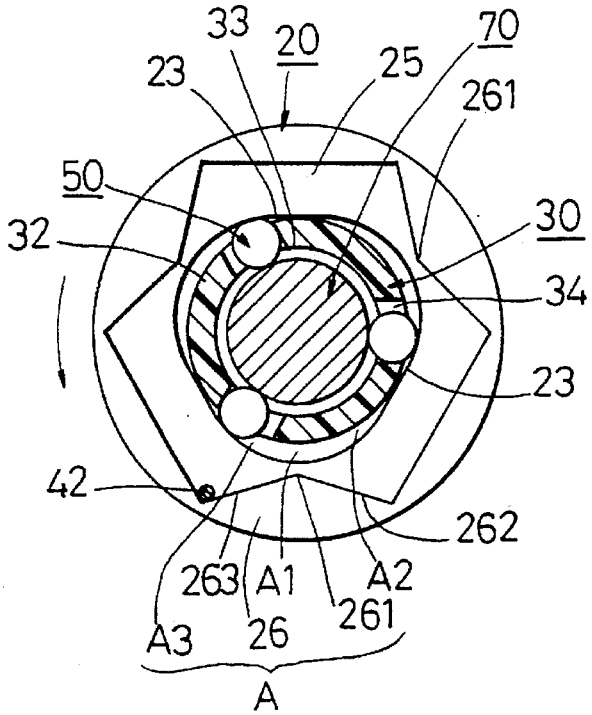
FIG. 4 is a sectional view illustrating the preferred embodiment when in a second operating mode.

Referring to FIG. 4, the rotary knob 60 is rotated to cause corresponding rotation of the positioning member 30 when it is desired to operate the preferred embodiment in a second operating mode. As shown, the insert leg 42 of the spring 40 has moved past the tip portion 261 so as to abut against the side portion 261. Under this condition, the locking rods 50 are disposed in the tapering end section (A3) of the respective clearance (A) and are in contact with the drive shaft 70 and the respective curved locking side 23. When the handle body 10 is rotated in a counterclockwise direction, the curved locking sides 23 force the locking rods 50 to contact tightly the drive shaft 70, thereby locking the drive shaft 70 to the handle body 10. When the handle body 10 is rotated in a clockwise direction, the locking rods 50 are disposed in the intermediate section (A1) of the respective clearance (A) and rotate freely to result in idle rotation of the handle body 10 and the seater 20 with respect to the drive shaft 70.

Therefore, by simply rotating the rotary knob 60, the position of the positioning member 30 and the locking rods 50 in the polygonal hole 22 can be altered to change the operating mode of the screwdriver.

The screwdriver of the present invention has a simple construction and can be easily assembled. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A screwdriver comprising:

a seater formed with an axially extending hole that is defined by a plurality of curved locking sides;

a positioning member having an annular rotary plate and a tubular portion which extends from said rotary plate and which is disposed in said hole, each of said locking sides forming a curved clearance with said tubular portion, said clearance having two tapering end sections and a wide intermediate section, said tubular portion being formed with a plurality of axially extending positioning slits adjacent to said locking sides respectively;

a plurality of cylindrical locking rods disposed respectively in said positioning slits;

a drive shaft extending through said positioning member and said seater and contacting said locking rods; and a rotary knob sleeved rotatably on said drive shaft for covering said rotary plate of said positioning member, said rotary knob having an inner wall surface formed with a plurality of locking projections which extend respectively into said positioning slits in order to permit rotation of said positioning member therewith;

whereby, by rotating said rotary knob, said positioning member can be rotated so as to dispose said locking rods in a selected one of said tapering end sections of said clearance that is formed between said tubular portion and the respective one of said locking sides in order to enable said locking rods to lock said drive shaft to said seater when said seater is driven to rotate in one direction and in order to enable said locking rods to permit idle rotation of said seater with respect to said drive shaft when said seater is driven to rotate in an opposite direction.

2. The screwdriver as claimed in claim 1, wherein:

said seater has one end formed with a central depression that is covered by said rotary plate of said positioning member, said central depression being defined by a surrounding wall which has a radial inward retaining projection;

said rotary plate is formed with a radial outward guide notch which extends from one of said positioning slits; and the screwdriver further comprises a spring disposed between said rotary knob and said rotary plate of said positioning member, said spring being formed as a thin curved strip with a first insert leg connected to said rotary plate and a second insert leg which extends into said guide notch and which is disposed in said central depression so as to abut against said retaining projection.

3. The screwdriver as claimed in claim 2, wherein said retaining projection is generally triangular in shape and has a tip portion aligned with one corner of said hole and a pair of inclined side portions.

4. The screwdriver as claimed in claim 1, further comprising a handle body which is formed with an axial insert hole for receiving said seater therein.

5. The screwdriver as claimed in claim 1, further comprising first and second retaining rings that engage said drive shaft, said first retaining ting being disposed adjacent to said seater, said second retaining ring being disposed adjacent to said rotary knob, said first and second retaining rings securing said seater, said positioning member, and said rotary knob on said drive shaft.

* * * * *